US009637953B2

(12) United States Patent
Bendel et al.

(10) Patent No.: US 9,637,953 B2
(45) Date of Patent: May 2, 2017

(54) ACTUATION DEVICE FOR A MOTOR VEHICLE DOOR LOCK

(71) Applicant: Kiekert Aktiengesellschaft, Heiligenhaus (DE)

(72) Inventors: Thorsten Bendel, Oberhausen (DE); Claus Toepfer, Sindelfingen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 71 days.

(21) Appl. No.: 14/351,769

(22) PCT Filed: Oct. 5, 2012

(86) PCT No.: PCT/DE2012/000977

§ 371 (c)(1),
(2) Date: Apr. 14, 2014

(87) PCT Pub. No.: WO2013/053346

PCT Pub. Date: Apr. 18, 2013

(65) Prior Publication Data

US 2014/0292005 A1 Oct. 2, 2014

(30) Foreign Application Priority Data

Oct. 12, 2011 (DE) ..... 20 2011 106 661 U

(51) Int. Cl.
*E05B 3/00* (2006.01)
*E05B 77/06* (2014.01)
*E05B 85/10* (2014.01)

(52) U.S. Cl.
CPC ..... *E05B 77/06* (2013.01); *E05B 85/10* (2013.01); *Y10T 292/57* (2015.04)

(58) Field of Classification Search
CPC ..... E05B 77/02; E05B 77/04; E05B 77/06; E05B 85/10; E05B 85/14; E05B 85/16
USPC ..... 292/216, 336.3, DIG. 22, DIG. 23, 292/DIG. 65
See application file for complete search history.

(56) References Cited

U.S. PATENT DOCUMENTS

| | | | | |
|---|---|---|---|---|
| 3,719,248 | A * | 3/1973 | Breitschwerdt et al. | 180/271 |
| 3,799,596 | A * | 3/1974 | Nozomu et al. | 292/216 |
| 6,042,159 | A * | 3/2000 | Spitzley et al. | 292/216 |
| 6,067,869 | A * | 5/2000 | Chilla et al. | 74/96 |
| 6,464,270 | B1 * | 10/2002 | Sloan et al. | 292/336.3 |
| 7,481,468 | B2 * | 1/2009 | Merideth et al. | 292/137 |
| 8,322,077 | B2 * | 12/2012 | Papanikolaou et al. | 49/460 |

(Continued)

FOREIGN PATENT DOCUMENTS

EP 1635016 A2 * 3/2006

OTHER PUBLICATIONS

International Search Report for corresponding patent application No. PCT/DE2012/000977 dated Feb. 21, 2013.

*Primary Examiner* — Alyson M Merlino
(74) *Attorney, Agent, or Firm* — Renner, Otto, Boisselle & Sklar, LLP

(57) ABSTRACT

The invention relates to an actuation device for a motor vehicle door lock (1), comprising a handle (7), and a locking lever (10) which renders the handle (7) inactive when accelerating forces of a predetermined magnitude occur, for example, in the event of an accident. In the normal operation, the locking lever (10) is displaced when impinged upon by the handle (7) and the handle (7) is simply rendered inactive in the locked operation.

11 Claims, 2 Drawing Sheets

(56) References Cited

U.S. PATENT DOCUMENTS

| | | | | |
|---|---|---|---|---|
| 2006/0038417 | A1 | 2/2006 | Pudney | |
| 2006/0049647 | A1* | 3/2006 | von zur Muehlen | 292/336.3 |
| 2007/0024068 | A1 | 2/2007 | Wood | |
| 2007/0080547 | A1* | 4/2007 | Lee | 292/336.3 |
| 2009/0322105 | A1 | 12/2009 | Lee et al. | |
| 2010/0237634 | A1 | 9/2010 | Gandhi | |
| 2011/0163554 | A1 | 7/2011 | Patel | |

* cited by examiner

ACTUATION DEVICE FOR A MOTOR VEHICLE DOOR LOCK

FIELD OF THE INVENTION

The invention relates to an actuation device for a motor vehicle door lock comprising a handle and a locking lever, which renders the handle ineffective when accelerating forces of a predetermined magnitude occur, for example in the event of an accident.

BACKGROUND OF THE INVENTION

The actuation device is usually mechanically coupled to the motor vehicle door lock via a connecting means, such as a Bowden cable, an actuating rod, etc. In the simplest arrangement the handle thus impinges a release lever inside the motor vehicle door lock. This release lever regularly lifts a pawl from a rotary latch so that the rotary latch opens with the aid of a spring and releases a previously retained locking bolt. As a result, the motor vehicle door lock is opened and an associated motor vehicle door can also be pivoted open or opened in any other manner.

The generic prior art according to DE 199 49 119 A1 provides a spherical control element.

The control element in turn acts on a securing part engaging in a groove-like recess in the event of a crash, blocking the handle.

The prior art based on the also generic DE 199 10 513 A1 discloses a similar design. In this case a locking lever is provided that interacts with a fixed counter-blocking surface. In the event of a crash and the resulting inertia forces, the locking lever moves into a blocking position locking the door handle.

Reference should also be made to the door lock disclosed in DE 2 023 859, used in particular for motor vehicles. This lock contains a pulling handle and a means activated by inertia. The pulling handle contains a shaft extending through an external door panel into the inside of the door. Inside the door, a balancing mass is pivotally arranged in such a way that in the event of a sudden change of the direction of movement against the external door panel, pivoting of the pulling handle in opening direction is prevented.

Prior art has generally proven to be successful but does have its limits if the locking lever has not been operated for a long time. Today the service life of vehicles is increasing with vehicles often lasting for more than 10 years. With designs based on prior art it is difficult to guaranty the functioning of the locking lever even after a considerable time. This is due to the fact that the locking lever is normally arranged in the area of an external door handle or an actuation device located at this point and is thus more or less exposed to weather effects, corrosion, etc. Such a design cannot guaranty that even after several years the desired and correct functioning is ensured and that passengers are offered the best possible protection in the event of an accident. The invention aims to remedy this situation.

SUMMARY OF THE INVENTION

The invention is based on the technical problem of further developing an actuation device for a motor vehicle door lock with the design described above in such a way that a permanent reliable functioning that is guaranteed for many years, can be provided.

To solve this technical problem a generic actuation device of the invention is characterized by the locking lever being deflected during normal operation when the handle is acted upon and only rendering the handle ineffective in the locked operation.

According to the invention the normal operation consequently corresponds to the locking lever being deflected when the handle is acted upon. In this context, normal operation means that no accelerating forces caused by an accident are applied. In general, each activation of the handle consequently also causes the locking lever to be deflected. Every time the external door handle or the handle provided in this area is, for instance, activated by a user for opening the respective vehicle door or is acted upon in any other way, the locking lever is deflected at the same time. This ensures that the respective bearings for the in most cases pivotally arranged locking lever cannot "stick" as a result of corrosion or, in the worst case, "seize up due to rusting". Instead, the constant and regular acting upon of the locking lever ensures that it retains its function even throughout a long service live of the vehicle and thus of the respective door lock as well as of the actuation device.

The locking lever thus ensures in the locked operation, i.e. typically in the event of accelerating forces resulting from an accident being applied, that the function of the handle becomes ineffective. This also means that any accelerating forces applied to the handle do not cause the release lever to be activated in the connected motor vehicle door lock. An associated motor vehicle door lock is thus not inadvertently opened.

The ineffectiveness of the handle in the locked operation can also be set up in such a way that the handle more or less carries out or can carry out an empty stroke in relation to the respective release lever, initiated by the locking lever in the locked operation. In general, the locking lever does, however, block the handle in the locked operation. For this purpose, the locking lever advantageously contains at least one mass of inertia.

The locking lever is actually generally a two-arm lever and, in particular, even a three-arm lever. The locking lever contains at least one stop arm interacting with the handle, where applicable and an inertia arm containing the mass of inertia. In addition, also a coupling arm connected to the handle may be provided.

Generally, the mass of inertia is connected at the end of the inertia arm. As the locking lever as a whole is pivotally mounted around an axis of rotation, for instance inside a motor vehicle door, significant torques can be produced and observed in the event of a crash with the aid of the mass of inertia connected to the end of the inertia arm.

The handle and the locking lever are generally permanently and elastically coupled. For this purpose, the coupling arm can be connected to the handle by means of a spring. In most cases, the spring is designed in such a way that it contains a spring constant adapted to inertia forces generated by the handle.

The handle also has a resetting means, returning it to its original position after its pivotable deflection as a result of the operation of the handle. The resetting means can be a return spring. The resetting means can, however, also be mechanically controlled. In most cases the arrangement is also designed in such a way that the resetting means acts upon the inertia arm.

Finally a stop is also typically assigned to the locking lever. The stop is designed as an inertia stop. As a result, the stop or inertia stop can restrict deflections of the locking lever caused by accelerating forces.

In normal operation the handle ensures that the locking lever is deflected against the resetting force by the return spring. As no significant forces are applied to the inertia mass during normal operation, this process corresponds to the locking lever carrying out a pivoting movement around its axis of rotation caused by the handle. During this process, the handle can carry along the locking lever by means of the spring and coupling arm.

In the locking operation the accelerating forces applied to the inertia mass ensure that the inertia mass and thus also the locking lever move or are pressed against the inertia stop. This fixes or secures the locking lever against the inertia stop as a result of the applied accelerating forces. Any forces applied to the handle can in some circumstances cause the spring connecting the coupling arm to the handle to be deflected.

In most cases, the spring constant of this spring is designed in such a way that the handle is only slightly deflected and that in any case the projection on the handle does not abut the stop arm of the locking lever. Generally this is, however, also permissible to ensure additional fixing of the handle with the aid of the locking lever. The handle is in any case blocked in the locking operation with the aid of the locking lever. As a result, the actuating lever in the motor vehicle door connected to the handle cannot be acted upon accidentally so that the motor vehicle lock remains unchanged in its "closed" position. These are the main advantages of the invention.

Below, the invention is explained with reference to drawings showing only one embodiment, in which:

DETAILED DESCRIPTION OF THE INVENTION

Figure 1:
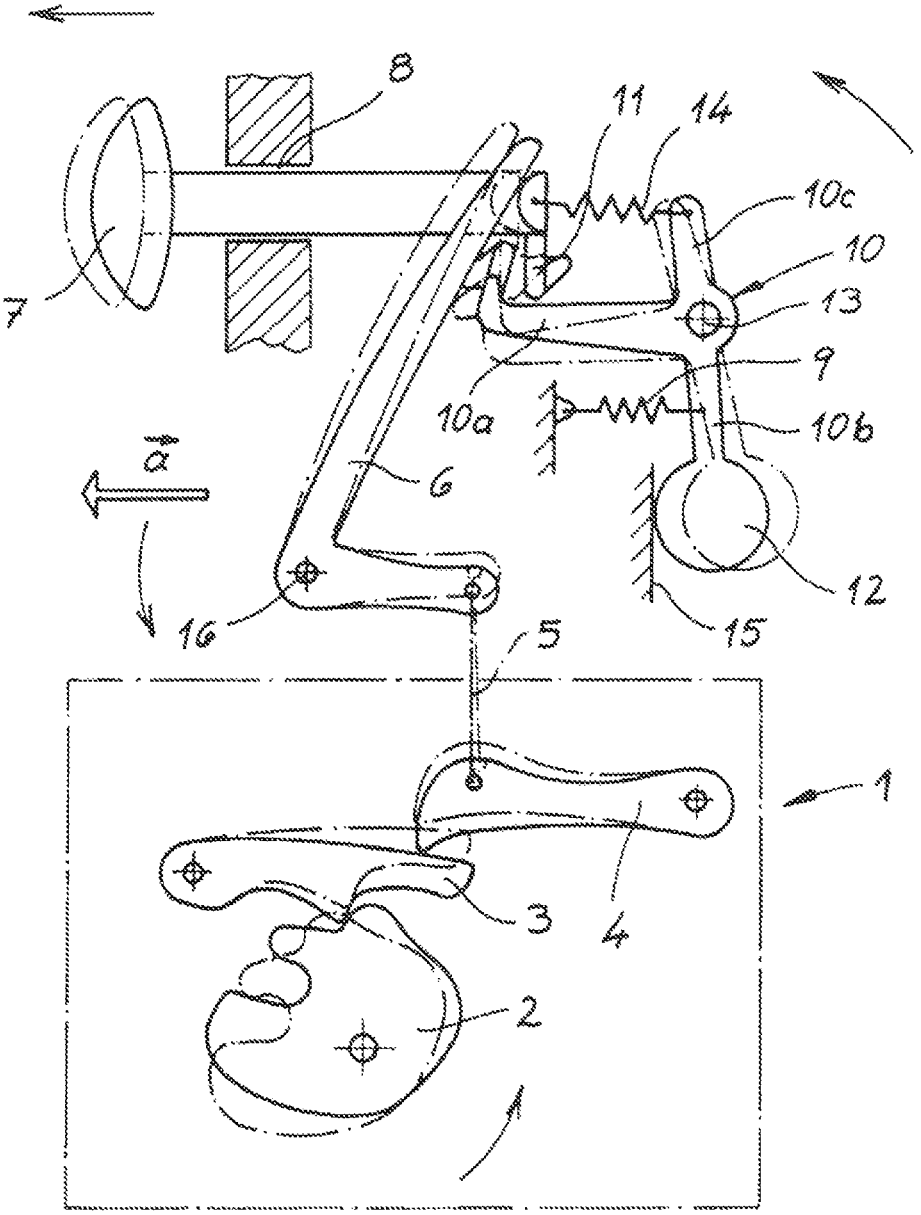
FIGS. 1 and 2 show a schematic view of the actuation device of the invention in various functional positions

The figures show an actuation device for a motor vehicle door lock 1. The basic design of the motor vehicle door lock 1 contains a locking mechanism 2, 3 comprising a rotary latch 2 and pawl 3. A release lever 4 acts on the pawl 3. The release lever 4 is connected to a deflection lever 6 via a flexible connecting means or a Bowden cable 5, said lever being acted upon by a handle 7.

Figure 2:
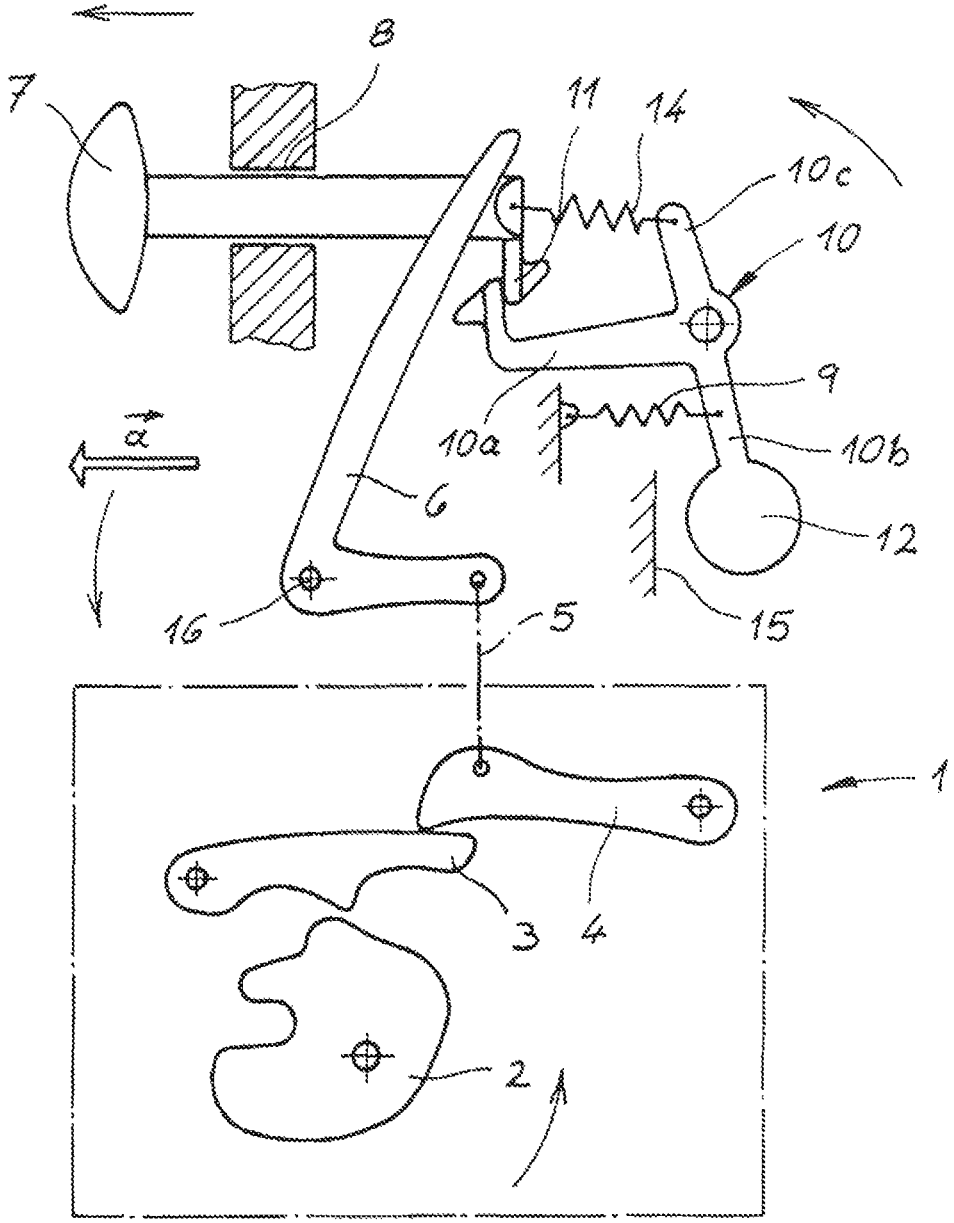

The handle 7 runs inside a duct 8 extending through an external door panel of a motor vehicle door—not shown in detail. The handle 7 is consequently an external door handle, although also an internal door handle could have a similar design. An operator can impinge the handle 7 by pulling said handle in the direction indicated in the figures by the arrow. Once acted upon by pulling, the handle 7 returns to its original position due to the return spring—not shown. During this normal operation, shown in FIG. 1, the original position is indicated by a continuous line, whilst the deflected position of the handle 7 is indicated by a dashed/dotted line. FIG. 2 shows the deflected position of the handle 7 in normal operation.

Apart from the motor vehicle door lock 1 and the handle 7, the actuation device also includes a locking lever 10. The locking lever 10 renders the handle 7 ineffective when accelerating forces a of a predetermined magnitude occur, for example, in the event of an accident. The respective accelerating forces are actually illustrated in the Figures by an arrow labeled a and correspond in this case to a side impact, although the invention is naturally not limited to this. In the event of a such a side impact or generally in the locked operation, the locking lever 10 actually ensures that the handle 7 is blocked. This process is shown in FIG. 1 in which the original position is shown by a continuous line. FIG. 2, on the other hand, shows the deflected position of handle 7 in normal operation as a continuous line. This corresponds to the dashed/dotted line in FIG. 1.

In the embodiment, the locking lever 10 is a three-arm lever. The locking lever 10 actually contains a stop arm 10*a*, which interacts or can interact with the handle 7. For this purpose the stop arm 10*a* is L-shaped and can interact with a projection 11 on the handle 7 as described.

Apart from the stop arm 10*a*, the locking lever 10 also contains an inertia arm 10*b* containing an inertia mass 12. The inertia mass 12 is arranged at the end of the inertia arm 10*b* in order to be able to generate a maximum torque in the locking operation for the locking lever 10 pivotable in relation to an axis of rotation 13.

Finally the locking lever 10 also contains a coupling arm 10*c* permanently and elastically connecting the locking lever 10 to the handle 7. For this purpose the coupling arm 10*c* and the handle 7 are connected by means of a spring 14. The additional return spring 9 engages in the locking lever 10 or, more precisely, in the inertia arm 10*b*. Instead of the return spring 9 also any other resetting means 9 can be used, ensuring that the locking lever 10 is returned to its original position shown in FIG. 1.

Finally the drawing also shows a stop 15 for the locking lever 10, defining the resting position of the locking lever 10. The stop 15 is fixed in position and can, for instance, be defined inside the motor vehicle door not specified in more detail. The stop 15 is an inertia stop 15 restricting deflections of the locking lever 10 or pivoting movements of the locking lever 10 around its axis of rotation 13, caused by accelerating forces $\bar{a}$.

The arrangement functions as follows. Starting from the original position of the actuation device indicated by the continuous line in FIG. 1, an impinging of the handle 7 in normal operation causes the handle 7 to be deflected or moved out in relation to the guide 8 associated therewith. This is shown by the dashed/dotted line in FIG. 1 and the continuous line in FIG. 2. The deflection of handle 7 carries along locking lever 10. This is primarily due to the spring 14 coupling the handle 7 to the locking lever 10. The impinging on the handle 7 in normal operation causes, in any case, the locking lever 10 to be pivoted counter-clockwise around its axis of rotation 13 during the transition from FIG. 1 to FIG. 2. During this process, the inertia mass 12 moves away from its associated inertia stop 15 and the locking lever 10 releases handle 7 after a specific angle of rotation.

As soon as the handle 7 is no longer impinged on, the return spring 9 ensures that the locking lever 10 returns to its original position indicated by the continuous line in FIG. 1. Handle 7 is also returned by the return spring—not shown. The inertia mass 12 then abuts the inertia stop 15 again. This means that any impinging of the handle 7 corresponds to the locking lever 10 being deflected or pivoted around its axis of rotation 13, as described.

Apart from deflecting the locking lever 10, the handle 7 primarily ensures that the transmission lever 6 is displaced around its axis 16 and also in counter-clockwise direction. As a result, the Bowden cable 5, connected to the transmission lever 6, is impinged on by pulling, pivoting the release lever 4 in clockwise direction so that it can lift the pawl 3 off the rotary latch 2. The rotary latch 2 is then released from the pawl 3 and also releases a locking bolt previously retained.

This is the normal functioning during the "opening" process of the motor vehicle door lock 1.

When in the event of a crash, greater accelerating forces a of a predetermined magnitude occur, which in case of a side impact typically move into the direction indicated by the arrows in the figures, the locking lever 10 ensures that the handle 7 is blocked in this locking operation. This is due to the fact that the respective accelerating forces a are applied primarily against the inertia mass 12 and ensure that the locking lever 10 or the inertia mass 12 are pressed against the associated inertia stop 15. In this way the locking lever 10 is able to also retain the handle 7, as also handle 7 is subjected to respective accelerating forces.

The arrangement is actually designed in such a way that the handle 7 only experiences a small deflection in relation to the locking lever 10 which is restricted by the spring 14 coupling the handle 7 to the locking lever 10. In case of greater forces, also the stop arm 10*a* in conjunction with the projection 11 on handle 7 can ensure the described blocking in the locking operation.

As a result of the handle 7 being blocked in its entirety with the aid of the locking lever 10, the transmission lever 6 is also not—unintentionally—deflected in the locking operation. The motor vehicle door lock 1 is consequently not impinged on by the handle 7 and remains in the "closed" position shown in FIG. 1. The same applies for the associated motor vehicle door, not specified in further detail, so that passengers inside the motor vehicle body are provided with maximum accident protection.

The invention claimed is:

1. An actuation device for a motor vehicle door lock, comprising a handle, and a locking lever, which renders the handle ineffective in a locked operation in response to accelerating forces of a predetermined magnitude that occur in the event of an accident, wherein, in a normal operation, the locking lever is displaced when impinged upon by the handle, and the handle is rendered ineffective in the locked operation;

wherein the locking lever has an axis of rotation about which the locking lever rotates during the normal operation, and the locking lever further contains a stop arm interacting with the handle during the locked operation and an inertia arm containing a mass of inertia, and the stop arm and the inertia arm extend in different directions directly from the axis of rotation non-linearly relative to each other;

and the locking lever is not displaced in response to the accelerating forces that occur in the event of an accident;

wherein the locking lever contains a coupling arm connected to the handle, and the coupling arm is connected to the handle by means of a spring.

2. The actuation device according to claim 1, wherein the locking lever blocks the handle in the locked operation, thereby rendering the handle ineffective.

3. The actuation device according to claim 1, wherein the mass of inertia is connected to an end of the inertia arm.

4. The actuation device according to claim 1, wherein the stop arm has an L-shaped end and the L-shaped end engages directly with a projection on the handle.

5. The actuation device according to claim 1, wherein the handle and the locking lever are permanently elastically coupled.

6. The actuation device according to claim 1, wherein the spring contains a spring constant adapted to inertia forces generated by the handle in response to the accelerating forces in the event of the accident.

7. The actuation device according to claim 1, wherein the locking lever contains a resetting means.

8. The actuation device according to claim 7, wherein the resetting means is designed as a return spring.

9. The actuation device according to claim 7, wherein the resetting means abuts the inertia arm.

10. An actuation device for a motor vehicle door lock, comprising a handle, and a locking lever, which renders the handle ineffective in a locked operation in response to accelerating forces of a predetermined magnitude that occur in the event of an accident, wherein, in a normal operation, the locking lever is displaced when impinged upon by the handle, and the handle is rendered ineffective in the locked operation;

wherein the locking lever has an axis of rotation about which the locking lever rotates during the normal operation, and the locking lever further contains a stop arm interacting with the handle during the locked operation and an inertia arm containing a mass of inertia, and the stop arm and the inertia arm extend in different directions directly from the axis of rotation non-linearly relative to each other;

the locking lever is not displaced in response to the accelerating forces that occur in the event of an accident; and wherein a stop and a return spring are provided for the locking lever, and the mass of inertia is biased against the stop by the return spring.

11. The actuation device according to claim 10, wherein the stop is designed as an inertia stop and restricts the deflection of the locking lever caused by the accelerating forces.

* * * * *